US007681503B1

(12) United States Patent
Fridley, Jr. et al.

(10) Patent No.: US 7,681,503 B1
(45) Date of Patent: Mar. 23, 2010

(54) SMOOTHBORE PROJECTILE

(75) Inventors: Perry L. Fridley, Jr., Fredericksburg, VA (US); Kenneth W. Tiedge, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 103 days.

(21) Appl. No.: 12/001,747

(22) Filed: Dec. 5, 2007

Related U.S. Application Data

(60) Provisional application No. 60/877,016, filed on Dec. 7, 2006.

(51) Int. Cl.
*F42B 30/02* (2006.01)

(52) U.S. Cl. ..... 102/385; 102/502; 102/512

(58) Field of Classification Search ..... 102/385, 102/502, 512
See application file for complete search history.

(56) References Cited

U.S. PATENT DOCUMENTS

| | | | | |
|---|---|---|---|---|
| 4,930,392 A | | 6/1990 | Wilson | 89/1.11 |
| 5,194,690 A | | 3/1993 | Guthrie et al. | 102/440 |
| 5,259,557 A | | 11/1993 | Spriggs et al. | 239/304 |
| 5,388,761 A | | 2/1995 | Langeman | 239/1 |
| 5,892,217 A | * | 4/1999 | Pollin | 244/3.3 |
| 6,042,262 A | | 3/2000 | Hajianpour | 366/139 |
| 6,352,218 B1 | * | 3/2002 | Holmqvist et al. | 244/3.29 |
| 6,755,133 B1 | * | 6/2004 | Brunn et al. | 102/502 |
| 2006/0180134 A1 | | 8/2006 | Illbuzzi | 124/74 |

* cited by examiner

*Primary Examiner*—Stephen M Johnson
(74) *Attorney, Agent, or Firm*—Gerhard W. Thielman, Esq.

(57) ABSTRACT

A projectile is provided for delivering a payload from a smoothbore launcher to a target. The projectile includes an aerodynamic stabilizer, an extender along which the stabilizer can longitudinally translate, and a chamber connected to the extender to contain the payload. The chamber can include a plastic bag for containing a liquid that represents the payload, and a plurality of holes that radially extend through its wall. The stabilizer enhances post-launch directional stability of the projectile by longitudinally translating rearward along the extender to shift center of pressure of the projectile aft of center of gravity of the projectile. The bag ruptures upon contact with the target, thereby disbursing the liquid through the holes. The bag can include malodorant or paint. The projectile can be contained within a gunpowder-loaded shotgun shell for launch.

17 Claims, 3 Drawing Sheets

SMOOTHBORE PROJECTILE

CROSS REFERENCE TO RELATED APPLICATION

Pursuant to 35 U.S.C. §119, the benefit of priority from provisional application 60/877,016, with a filing date of Dec. 7, 2007, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to non-lethal smoothbore projectiles. In particular, this invention provides components and assembly of smoothbore projectiles for enhanced delivery of non-lethal liquid substances to be dispersed (or alternatively a solid round) with improved accuracy and increased range.

Uniformed civil authorities (e.g., law enforcement officials) can be tasked with mob dispersal, such as by riot control procedures and equipment, including release of chemicals that produce sensory irritation and/or temporary physical disablement, known as riot control agents. United States military personnel are prohibited by the Chemical Weapons Convention (ratified April 1997) from "method of warfare" use of such agents that include Oleoresin Capsicum (OC) and Lachrymator. As a consequence of prohibition on "method of war" usage, the United States Armed Forces do not employ RCA substances as anti-personnel weapons, whether for crowd control, interdiction, arrest or other law enforcement uses.

OC, popularly called "pepper spray", is biodegradable and can be obtained from cayenne's oily resin. Contact with OC particles induces irritation in skin, eyes, respiratory tract and mucus membranes, rendered inert by proper ventilation and water flushing of the affected tissues. Carriers for OC aerosol delivery to spray against a target have included water, isopropyl-alcohol, methylene chloride, etc. Lachrymator can be used as tear gas that stimulates the corneal nerves in the eyes to induce tears, pain and even temporary blindness. Commonly used chemicals used as lachrymators include bromoacetone, benzylchloride, thiophene, xylyl bromide, chlorine and bromine.

The burning and painful sensations associated with capsaicin result from its chemical interaction with sensory neurons. Capsaicin, as a member of the vanilloid family, binds to an ion channel-type receptor that permits cations to pass through a cell membrane. In response, the neuron depolarizes, stimulating a signal to the brain, thereby producing the same sensation that excessive heat or abrasive damage would cause. At standard conditions (room temperature and pressure), capsaicin is a solid. Hence aerosol delivery of capsaicin may involve nebulization of a capsaicin-saline solution that includes diethyleneglycolmonoethylether (DGME) and ethanol as an aerosol vehicle.

SUMMARY

Conventional delivery mechanisms of liquid splash rounds yield disadvantages addressed by various exemplary embodiments of the present invention. In particular, the embodiments described below provide larger payload carrying capacity coupled with improved accuracy at greater ranges than available with conventional means.

Various exemplary embodiments provide a non-penetrating splash round containing a liquid payload that is non-lethal and accurate at ranges commensurate with current rules of engagement in narcotics interdiction and law enforcement. The delivery system contains the liquid integrally during storage and during delivery to the target, where upon impact the liquid dispenses (by disbursement). The splash round may be dispatched by a smoothbore launcher, such as a 12-gauge shotgun.

Various exemplary embodiments provide a projectile for delivering a payload from a smoothbore launcher to a target. The projectile includes an aerodynamic stabilizer, an extender along which the stabilizer can longitudinally translate, and a chamber connected to the extender to contain the payload.

In various exemplary embodiments, the chamber includes a plastic bag for containing a liquid that represents the payload, and a plurality of holes that radially extend through its wall. The stabilizer enhances post-launch directional stability of the projectile by longitudinally translating rearward along the extender to shift center of pressure of the projectile aft of center of gravity of the projectile. The bag ruptures upon contact with the target, thereby disbursing the liquid through the holes. The bag can include malodorant, paint or other desired liquid. The projectile can be contained within a gunpowder-loaded shotgun shell for launch. In alternate embodiments, the payload in the chamber can be solid rubber.

Various exemplary embodiments also provide a mount to rigidly attach the extender chamber to the extender, for which the stabilizer slidably translates along said extender, along with a governor to limit longitudinal translation of the stabilizer along the extender. The stabilizer can include a ring that slidably connects to said extender and a plurality of fins attached to said ring. The chamber can further include a weighted nose cap to shift the projectile's center of gravity forward.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Smoothbore Projectile: Delivery of a riot control agent (RCA) to a target can be accomplished by launching a projectile that contains the RCA towards the target. The projectile is intended for propelled ejection from a medium-to-large-caliber smoothbore barrel, such as a shotgun or grenade launcher. For example, a violent or threatening person(s) can be targeted by a projectile as described for various exemplary embodiments.

In various exemplary embodiments for a common shotgun, the projectile contains a liquid or solid non-lethal payload of five milliliters (5 ml) for delivery as a "splash-round" to a target to a distance range of 80-100 yards in an accurate and repeatable fashion for improved reliability. By contrast, conventional paintball delivery systems deliver a payload accurately only to 20 or 30 yards with the payload of only one-to-two milliliters (1-2 ml). Thus, the exemplary delivery system for common shotgun weapons delivers a factor of two-to-four more payload accurately out to three-to-five times greater distances. The smoothbore delivery system can also be utilized in any size shotgun bore, e.g., 37 mm flaregun, 40 mm grenade, or any other smoothbore weapons.

Figure 1A:
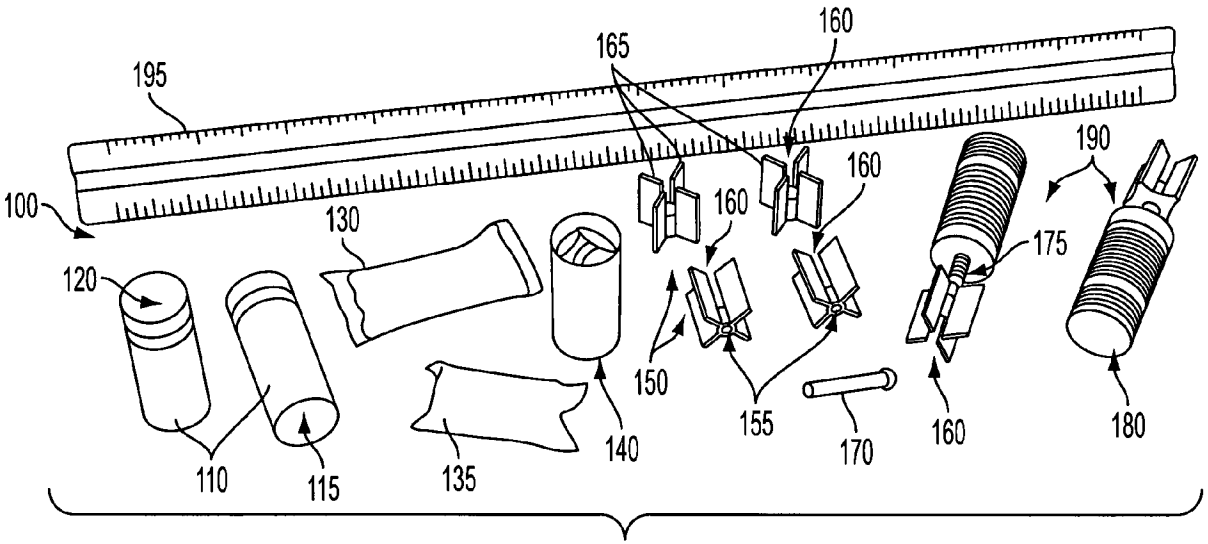
FIGS. 1A-1C are perspective view of smoothbore projectile assemblies and their components.

FIG. 1A shows a perspective view of exemplary embodiments for a smoothbore projectile, including component and assembly items 100. A plastic cup 110 as a cylindrical tube having an open fore nose 115 and an aft closure 120 forms the payload-containing shell of the projectile. The cup 110 is designed to contain a sealed plastic bag inserted through the nose 115. The cup 110 represents a containment chamber for the payload. The cup 110 may be longitudinally cylindrical in preferred embodiments, but artisans of ordinary skill will recognize alternate shapes to accomplish these objectives.

The bag may be filled with a clear liquid, such as shown in a clear polymer bag 130, or alternatively a paint suspension, such as shown in an opaque polymer bag 135. The cup 110 containing the opaque bag 135 is shown as a filled shell body 140. The cup 110 may include small through-holes through its cylindrical wall, as well as an orifice (see FIG. 2) at the aft closure 120, for reasons discussed subsequently. The bag 130, 135 may be composed of fluorinated ethylene propylene (FEP) resin called Teflon® FEP from DuPont, with a thickness of 0.004 inch (4 mil) and a volumetric capacity of five milliliters. Upon impact with the target, the sudden deceleration causes the bag to rupture, releasing the liquid contained therein to be ejected through the through-holes.

The projectile can be directionally stabilized by a multi-fin tail 150 that optionally may include a thin disk 145 (FIG. 1C) at its fore. The tail 150, which can be molded from urethane, includes an attach ring 155, a distal portion (or gap) 160 and a set of four rectangular fins 165 in cruciform pattern extending from the attach ring 155. The fins 165 are typically straight for fin stabilization, but alternatively may optionally be twisted along an axial direction of the projectile to provide spin stabilization. Other geometries for fin arrangement, cross-section and planform may be used to represent a comparable aerodynamic stabilizer without departing from the scope of the claims.

A rear-facing shaft 170 extends longitudinally from the aft closure 120 of the cup 110 along the projectile's axis of symmetry, and may be attached via the orifice therethrough. Connection of the shaft 170 to the closure 120 is described further herein, and various attachment techniques can be considered without departing from the scope of the invention.

The ring 155 can slide along the shaft 170. During storage and loading, the ring 155 may abut against the aft closure 120 to reduce occupation volume and improve handling structural integrity. After launch of the projectile, aerodynamic drag against the fins 165 pushes the tail 150 rearward along the shaft 170. An optional helical spring 175 may provide supplemental force to translate the tail 150 rearward along the shaft 170. Further, alternate tail extension devices besides a shaft may be envisioned by artisans of ordinary skill, including an integral tail-extension device that longitudinally translates towards or away from the cup 110.

The fore end of the cup 110 can be sealed with a weighted cap 180. The fins 165 provide lateral aerodynamic stability for the projectile and rearward translation along the shaft 170 shifts the projectile's center of pressure to be aft of the center of gravity (or of gravity) that can be designed towards the nose 115 by the cap 180.

Figure 1C:
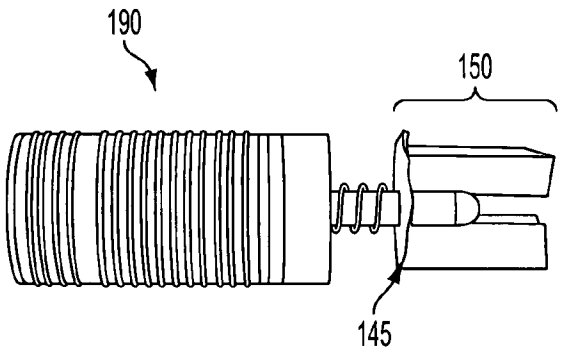
Figure 1B:
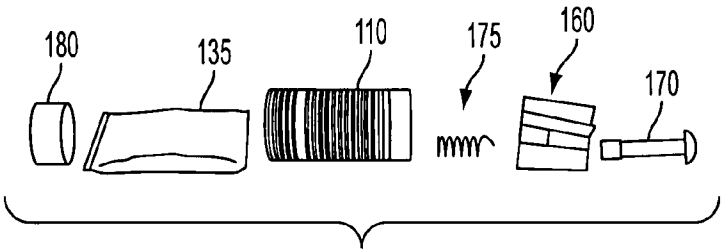

These components can be combined together as a delivery assembly 190. A scale comparison to a ruler 195 illustrates generalized size of the projectile and its components 100 for a shotgun-sized projectile. Alternatively, the cup 110 and the shaft 170 may be injection molded together in a single piece out of hard polymer. FIG. 1B shows a perspective view of the exploded components of the projectile, including the cap 180 and spring 175 as respectively separate from the cup 110 and shaft 175. FIG. 1C shows a perspective of the assembly 190, together with the disk 145 as labeled.

The cap 180 may be composed, for example of epoxy cement loaded with tungsten powder to plug the nose 115 of the cup 110. The cap 180 of a 12-gauge shell may contain, for example, five grams (5 g) tungsten powder with two grams (2 g) epoxy. By weighting the cap 180 and extending the tail 150, the projectile's center of gravity may be positioned forward of the center of pressure, thereby fin-stabilizing the projectile in flight. Alternate compositions for weighting the forward tip of the projectile may also be considered without departing from the invention's scope.

Figure 2:
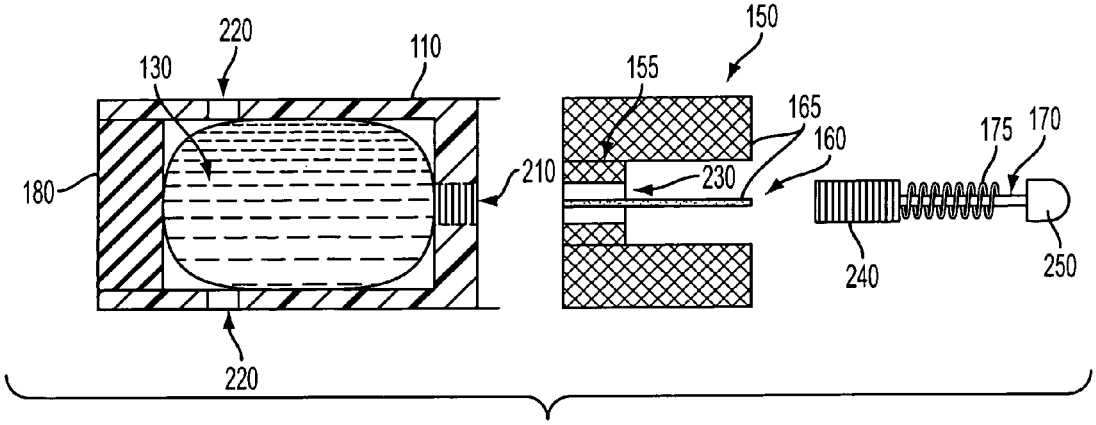
FIG. 2 is an elevation view of smoothbore projectile components.

FIG. 2 shows an elevation view of a smoothbore 12-gauge projectile 200 in partially exploded form. The plastic cup 110 contains the sealed plastic bag 130 (or 135) filled with clear or opaque liquid and sealed at the nose 115 by the weighted cap 180. A threaded orifice 210 for mounting the tail 150 penetrates the cup's aft closure 120 and is aligned with the axisymmetric centerline of the cup 110. To produce the orifice 210, the cup 110, preferably composed of a commercial polymer, may be tapped with a 10-32 thread.

The cup 110 may include through-holes 220 that penetrate through its cylindrical wall. Exemplary dimensions of the cup 110 for launch from a 12-gauge shotgun shell may include exterior cylinder wall diameter of 0.725 inch, an exterior length of 1.625 inch, and an interior diameter of 0.650 inch. The closure 120 may have a thickness of 0.375 inch, with an extension rim of 0.125 inch to the cup's end as a spacer to the tail 150.

The tail 150 includes the proximal ring 155 having a through-hole 230, the aft distal gap 160 and the cruciform fins 165 mounted to the ring 155. The tail 150 may preferably be composed of polyurethane and/or a light metal, and the ring 155 and fins 165 may be composed of a unitary item. The tail's through-hole 230 aligns coaxially with the threaded orifice 210 in the cup 110. Exemplary dimensions of the tail 150 for launch from a 12-gauge shotgun shell may include radial extension of the fin to 0.750 inch and a length of 0.750 inch.

The shaft 170 may be mounted to a threaded plug 240 at its proximal end and terminates with a knob 250 at its distal end for inhibiting the ring 155 from detaching from the shaft 170.

Thus, the plug 240 represents a rigid mounting mechanism, whereas the knob 250 represents a governor to limit the tail's axial motion. The shaft 170 and/or plug 240 may be preferably composed of a light metal, such as titanium and aluminum, or alternatively a strong light plastic. A thin disk 145 (FIG. 1C) may optionally be attached to the fins' fore end with a foam spacer to confine the gunpowder and thereby improve combustion. The spring 175 may be disposed between the plug 240 and the knob 250 to extend the tail 150 rearward after launch.

Exemplary dimensions of the shaft 170 (exposed portion) for launch from a 12-gauge shotgun shell may include shaft diameter of 0.150 inch and an axial length of 0.50 inch. Similarly, the knob 250 may have an axial length of 0.25 inch and have total radial extension of 0.19 inch. The total length of the plug 240, shaft 170 and knob 250 may be 1.00 inch. The disk 145 may have a diameter of 0.72 inch and a thickness of 0.003 inch with a 0.193 inch center hole and be composed of a common material, such as paper.

Alternatively, the tail 150 and the shaft 170 may form an integral unitary stabilizer that translates rearward from the cup 110 after launch. An example design includes the shaft 170 having a rim lip that extends into the cup 110. The rim lip possesses a larger diameter than the threaded orifice 210 to prevent ejection from the closure 120 as the integral shaft and tail translate rearward after launch.

The liquid payload contained within the bag 130 may include approximately five milliliters (5 ml) of liquid payload. Subsequent to inserting the bag 130 into the cup 110, two grams (2 g) of epoxy mixed with five grams (5 g) of tungsten powder may be subsequently poured into the remaining space in the cup 110 in order to seal in the payload. Flexane®-80 urethane putty represents a preferred epoxy that can be mixed with diluents to adjust the durometer hardness of the final cured material.

The components for the projectile may be combined as the assembly 190 by (a) connecting the shaft 170 to the plug 240, (b) sliding the tail 150 along the shaft 170 and securing it by the knob 250, (c) tapping the closure 120 of the cup 110 as a threaded orifice 210 to receive the plug 240 and providing holes 220 along the cup's cylindrical sides, (d) inserting the bag 130 into the cup 110, (e) sealing the bag 130 with the cap 180. The shaft 170 may be designed to enable sufficient longitudinal travel of the tail 150 to provide fin stabilization. Upon assembly, the projectile may be inserted into the shell 260 for ejection from a smoothbore launcher towards an intended target.

Figure 3A:
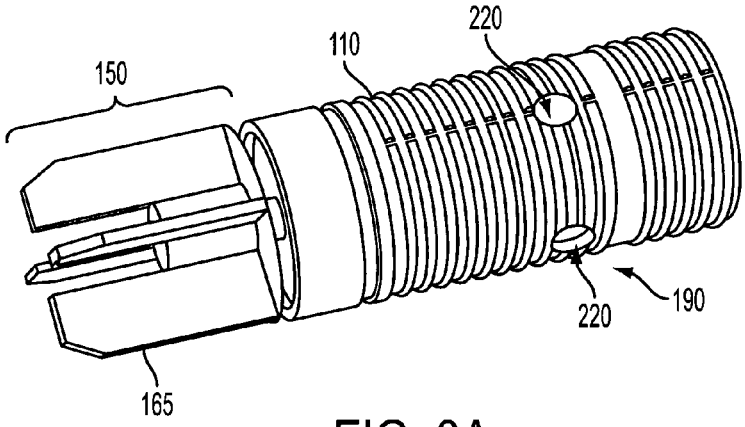
FIGS. 3A and 3B are perspective views of smoothbore projectiles.
Figure 3B:
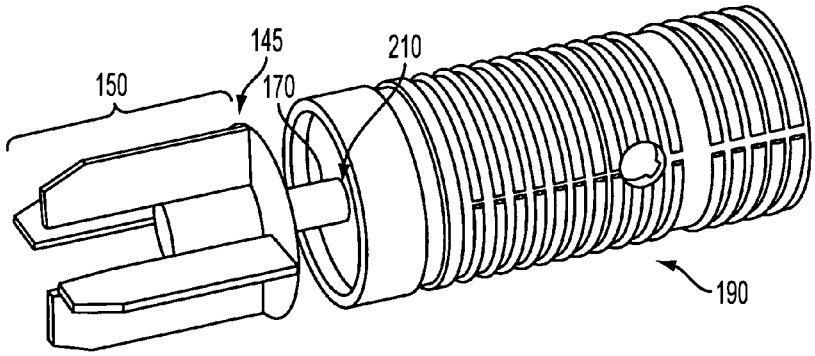

FIGS. 3A and 3B show perspective views of the assembly 190 with the tail 150 in stowed and deployed positions, respectively. FIG. 3A identifies the cup 110 with the through-holes 220 shown. FIG. 3B shows the shaft 170 extending from the threaded orifice 210 at the cup's aft end (without the optional spring) identifies the cup 110 with the through-holes 220 shown. During flight, aerodynamic drag against the fins 165 induces the tail 150 to move aft along the shaft 170 relative to the assembly 190.

Figure 4:
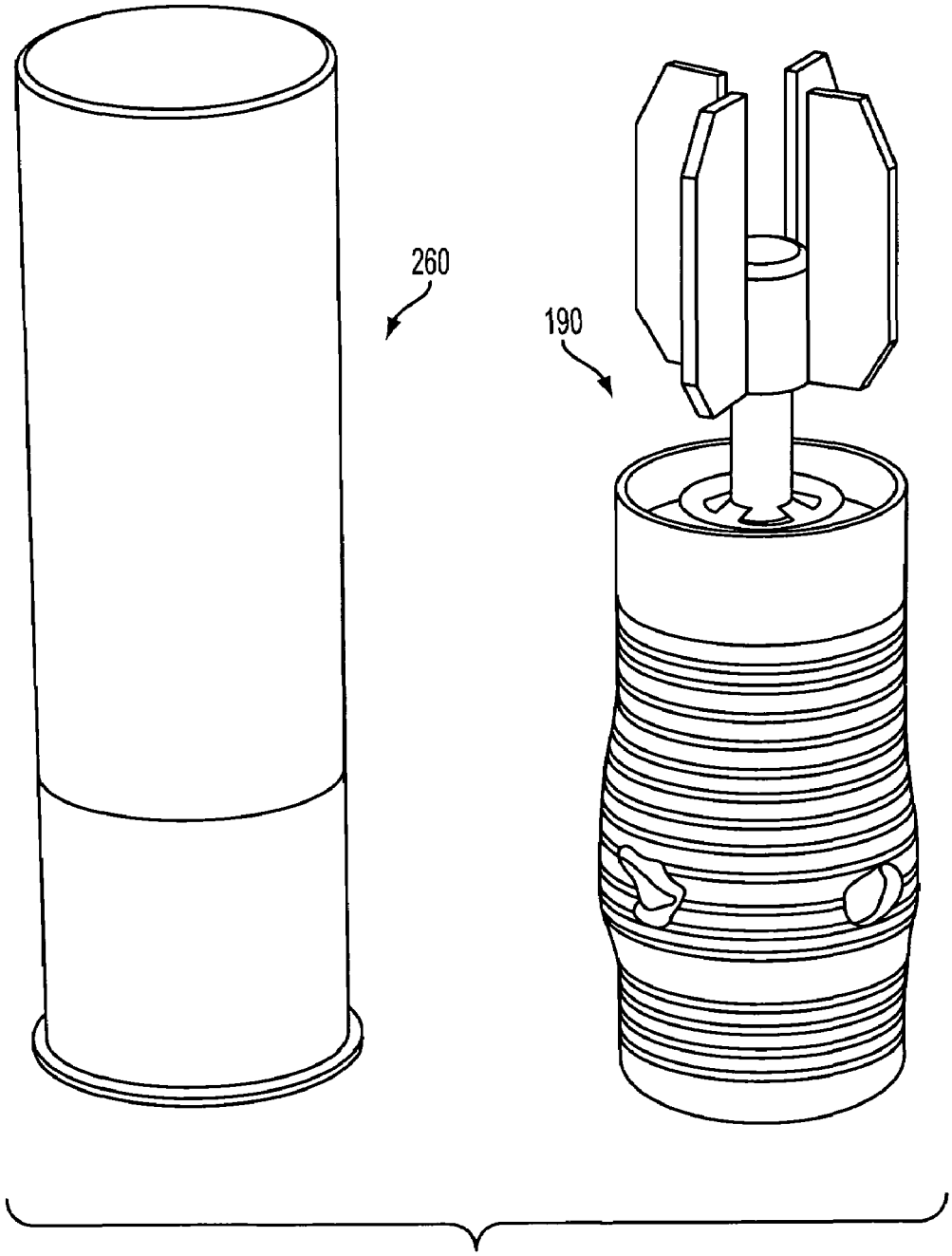
FIG. 4 is a perspective view of a projectile adjacent a shotgun shell.

FIG. 4 shows a 12-gauge shotgun shell 260 into which the assembly 190 may be inserted (tail-first) through an opening (at the top) for launch. The shell 260 may be discarded after the assembly 190 has been launched as a projectile to deliver the liquid contained in the bag 130 to the target. Alternatively, the bag 130 can be replaced with a solid fill in the cup 110, thereby transforming the projectile into a "rubber bullet" with greater targeting accuracy than conventional designs.

The assembly 190 may be loaded into a primed 3-inch shotgun shell 260 containing 12 grains of Red Dot smokeless gunpowder from Alliant in Radford, Va. The powder may be disposed above a primer, both opposite the opening (at the bottom). The projectile is secured in the shell 260 with contact cement by coating the cup's exterior cylindrical wall, immediately loading the assembly 190 into the shell 260, and allowing the cement to cure before firing. Crimping of the shell 260 is not preferred. The shell's interior may preferably be sealed to increase combustion pressure from gunpowder burning by the cement that reduces annular gas leakage between the cup 110 and the shell 260 and around the tail 150.

Liquid Payload: The liquid to be delivered in the bag 130 may be composed of materials for use in counter-narcotics interdiction and to provide short-term disabling effects for crowd dispersal or checkpoint control. Under selective police operations, capsaicin and/or other OC-equipped payloads may be considered. Military restrictions on RCA materials encourage development of alternative non-lethal agent, such as a malodorant to produce an identifiably pungent response of the olfactory senses.

Tagging the target by a marker represents an alternative technique of non-lethal operation against hostile persons in contrast to dispensing a substance to stimulate a reaction by the target. In particular, the liquid contained in the (clear) bag 130 may include a dye, or alternatively, may provide an opaque emulsion, such as paint, as in the bag 135.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A projectile for delivering a payload from a smoothbore launcher to a target, the projectile comprising:

an aerodynamic stabilizer;

an extender along which said stabilizer can longitudinally translate;

a governor to limit longitudinal translation of said stabilizer along said extender;

a chamber housing that defines a cavity to contain the payload, said chamber housing connected to said extender;

a mount to rigidly attach said chamber housing to said extender, wherein said stabilizer slidably translates along said extender; and a helical spring disposed along said extender between said mount and said governor, wherein said stabilizer enhances post-launch directional stability of the projectile by said spring imposing tensile force between said mount and said governor to longitudinally translate said stabilizer rearward along said extender for shifting center of pressure of the projectile aft of center of gravity of the projectile.

2. The projectile according to claim 1, wherein said chamber housing further includes a weighted nose cap to shift the projectile's center of gravity forward.

3. The projectile according to claim 1, wherein said stabilizer further includes a ring that slidably connects to said extender and a plurality of fins attached to said ring.

4. The projectile according to claim 1, wherein the payload is solid rubber.

5. The projectile according to claim 1, wherein said chamber housing having a cylindrical wall and further comprises:

a plastic bag within said cavity for containing a liquid that represents the payload; and a plurality of holes that radially extend through said cylindrical wall, and said bag ruptures upon contact with the target, thereby disbursing said liquid through said plurality of holes.

6. The projectile according to claim 5, wherein said liquid is a malodorant.

7. The projectile according to claim 5, wherein said liquid is paint.

8. The projectile according to claim 1, wherein the projectile is contained within a gunpowder-loaded shotgun shell for launch.

9. A projectile for delivering a payload from a smoothbore launcher to a target, the projectile comprising:

an aerodynamic stabilizer;

an extender along which said stabilizer can longitudinally translate; and a chamber housing that defines a cavity to contain the payload, said chamber housing connected to said extender, said chamber having a cylindrical wall and including:

a plastic bag within said cavity for containing a liquid that represents the payload; and a plurality of holes that radially extend through said cylindrical wall, wherein said stabilizer enhances post-launch directional stability of the projectile by longitudinally translating rearward along said extender to shift center of pressure of the projectile aft of center of gravity of the projectile, and said bag ruptures upon contact with the target, hereby disbursing said liquid through said plurality of holes.

10. The projectile according to claim 9, further comprising:

a mount to rigidly attach said extender chamber to said extender, wherein said stabilizer slidably translates along said extender.

11. The projectile according to claim 10, further comprising:

a governor to limit longitudinal translation of said stabilizer along said extender.

12. The projectile according to claim 9, wherein said chamber housing further includes a weighted nose cap to shift the projectile's center of gravity forward.

13. The projectile according to claim 9, whereto said stabilizer further includes a ring that slidably connects to said extender and a plurality of fins attached to said ring.

14. The projectile according to claim 9, wherein said liquid is a malodorant.

15. The projectile according to claim 9, wherein said liquid is paint.

16. The projectile according to claim 9, wherein the projectile is contained within a gunpowder-loaded shotgun shell for launch.

17. The projectile according to claim 9, further comprising:

a governor to limit longitudinal translation of said stabilizer along said extender;

a mount to rigidly attach said chamber housing to said extender, wherein said stabilizer slidably translates along said extender; and a helical spring disposed along said extender between said mount and said governor, wherein said spring imposing tensile force between said mount and said governor to longitudinally translate said stabilizer rearward along said extender.

* * * * *